US009448027B1

(12) United States Patent
Zinsner

(10) Patent No.: US 9,448,027 B1
(45) Date of Patent: Sep. 20, 2016

(54) BARREL NUT WITH TWO-PIECE SEPARABLE EXTENSION

(71) Applicant: Brendon B. Zinsner, Sarasota, FL (US)

(72) Inventor: Brendon B. Zinsner, Sarasota, FL (US)

( * ) Notice: Subject to any disclaimer, the term of this patent is extended or adjusted under 35 U.S.C. 154(b) by 0 days.

(21) Appl. No.: 14/599,508

(22) Filed: Jan. 18, 2015

Related U.S. Application Data

(60) Provisional application No. 62/104,739, filed on Jan. 17, 2015.

(51) Int. Cl.
*F41A 21/48* (2006.01)

(52) U.S. Cl.
CPC ..... *F41A 21/482* (2013.01)

(58) Field of Classification Search
CPC ..... F41A 21/481–21/488; F41A 21/48
See application file for complete search history.

(56) References Cited

U.S. PATENT DOCUMENTS 5,590,484 A * 1/1997 Mooney ..... F41G 1/16 42/111
6,671,990 B1 * 1/2004 Booth ..... F41C 23/16 42/75.01
7,216,451 B1 * 5/2007 Troy ..... F41C 23/16 42/71.01
8,240,074 B2 * 8/2012 Vuksanovich ..... F41A 21/48 42/75.02
8,276,304 B2 * 10/2012 Samson ..... F41C 23/16 42/112
8,359,779 B2 * 1/2013 Daniel ..... F41C 23/16 42/71.01
8,607,490 B1 * 12/2013 Zinsner ..... F41C 23/16 42/71.01
8,726,559 B1 * 5/2014 Mueller ..... F41A 21/482 42/75.02
8,863,426 B1 * 10/2014 Zinsner ..... F41C 23/16 42/71.01
2004/0049964 A1 * 3/2004 Vais ..... F41A 21/482 42/75.02
2007/0199435 A1 * 8/2007 Hochstrate ..... F41A 3/66 89/191.02
2011/0289813 A1 * 12/2011 Serandour ..... F41A 21/488 42/76.01
2012/0131834 A1 * 5/2012 Barrett ..... F41A 3/26 42/75.02
2012/0216439 A1 * 8/2012 Barrett ..... F41A 3/26 42/75.02
2014/0026459 A1 * 1/2014 Yan ..... F41C 23/16 42/71.01
2015/0198403 A1 * 7/2015 Bentley ..... F41A 21/484 42/75.02
2015/0266168 A1 * 9/2015 Geissele ..... B25B 13/48 29/525.11
2016/0010938 A1 * 1/2016 Merkley ..... F41A 21/482 42/75.02

* cited by examiner

*Primary Examiner* — Troy Chambers
*Assistant Examiner* — Bridget Cochran
(74) *Attorney, Agent, or Firm* — Dorothy S. Morse

(57) ABSTRACT

A quick-attach/quick-detach coupler assembly used for mounting a hand guard around a rifle barrel, allowing prompt barrel change. The coupler assembly has a generally cylindrical barrel nut with a plurality of external rail-mounting teeth centrally around its exterior circumference, interior threads for connection to the upper receiver of a rifle, and multiple fastener holes allowing set screws to contact a two-piece separable extension and provide anti-rotational engagement between it and the barrel nut. The barrel nut's interior threads also connect it to the extension. A tool configured as a hand guard fastener and stored/carried on the hand guard is easily accessed to tighten/release the set screws. The tool's handle may also be configured to engage notches on the extension's barrel end and facilitate its release from the barrel nut. The coupler assembly will mount almost every hand guard currently marketed to the upper receiver of the AR family of rifles.

14 Claims, 5 Drawing Sheets

BARREL NUT WITH TWO-PIECE SEPARABLE EXTENSION

CROSS-REFERENCES TO RELATED APPLICATIONS

The patent application is related in subject matter to U.S. provisional patent application filed by the same inventor on Jan. 17, 2014, which is entitled TOOLS QUICKLY ATTACHABLE TO A RIFLE HAND GUARD and was given the application No. 62/104,739. Since there is subject matter in his U.S. provisional patent application 62/104,739 that provides important information for the inventor's present invention herein including interpretation of claim language, he respectfully requests that a domestic priority link be granted for the currently filed U.S. utility patent application based upon his earlier filed U.S. provisional patent application 62/104,739.

BACKGROUND

1. Field of the Invention

The present invention generally relates to barrel nuts used to mount a forward hand guard assembly around the barrel of a rifle, particularly to a multi-caliber quick-change coupler assembly which is used to secure a rifle barrel to the upper receiver of a rifle while also allowing prompt access to the barrel and quick barrel change, and which further can be used to mount almost every hand guard assembly currently marketed to the upper receiver of the AR family of rifles.

The present invention multi-caliber quick-change coupler assembly comprises a barrel nut and a two-piece separable extension with a secure but promptly releasable threaded connection between them. The barrel nut has a generally cylindrical and open-ended configuration, approximately half of which has interior threads that extend from its receiver end centrally into the barrel nut. The portion of the interior threads adjacent to its receiver end is used for secure connection of the barrel nut to the forward end of the upper receiver of a rifle, while the interior threads more centrally positioned within the barrel nut are used for repeat engagement and release of the two-piece separable extension to lock the flange of a rifle barrel against the rifle's upper receiver as portions of the barrel adjacent to the flange extend through the barrel nut, the two-piece extension, and the rifle's upper receiver. Once connection of the two-piece extension to the barrel nut is released through the use of a hand guard supported fastener-tool, spanner wrench, or by other means, the two pieces of the extension are immediately separable from one another and after such separation can be easily lifted away from the rifle barrel while the barrel remains extending through the present invention barrel nut, which still has a threaded connection to the rifle's upper receiver. Also, since the barrel's flange is no longer locked against the upper receiver by the two-piece extension, the rifle barrel is easily pulled through the present invention barrel nut and away from both the upper receiver and the barrel nut.

During rifle use, the threaded connection between the present invention two-piece extension and barrel nut is further secured by set screws extending through fastener holes in the barrel nut and engaging the exterior surface of the two-piece extension, which while providing anti-rotational engagement between the two-piece extension and the barrel nut during rifle use also allows prompt separation of the two-piece extension from the barrel nut for quick barrel change, particularly when a fastener-tool with a tool end configured for set screw attachment and release is stored/carried by a hand guard assembly mounted upon the barrel nut where it is immediately available to the hunter or outdoorsman carrying the rifle. Also, to facilitate quick barrel change, the present invention barrel nut purposefully has no interior threads at or near its barrel end, allowing the exterior threads on the outside surface of the two-piece extension to quickly pass through the non-threaded interior surface on the barrel end of the barrel nut before reaching and becoming engaged with the centrally-located portion of the barrel nut's interior threads. Furthermore, for mounting a hand guard assembly around a rifle barrel when the present invention coupler assembly is used to secure the rifle barrel into its needed position of use, the present invention barrel nut also comprises a plurality of radially-extending and gear-like exterior teeth centrally around its exterior circumference. An external groove is also provided on the receiver end of the present invention barrel nut to assist in the mounting of older hand guard assemblies, so that almost every hand guard assembly currently marketed can be mounted to the upper receiver of the AR family of rifles. No similar structure is currently known in the prior art, nor one that provides the same benefits and advantages as the present invention.

2. Description of the Related Art

Use of forward hand guards for rifles is now common and provides multiple advantages. They insulate the shooter's hand from the heat of a rifle barrel. They also can include provisions (such as groove sets on one or more of its sides commonly referred to as a rail) for mounting accessories to the rifle such as, for example, a flashlight aligned with the barrel to illuminate the area in front of the weapon in low light. On early rifles, accessory mounting devices were almost exclusively employed for mounting telescopic sights and were thus provided mainly on the top portion of the rifle's receiver. However, commonly today for militarized assault rifles such as the M16, accessory mounting provisions are found on the hand guard (commonly known as Picatinny rails since they were developed at the Picatinny Arsenal), with one or more Picatinny rails typically found on each hand guard. Picatinny rails are standardized in structure, with dimensional specifications found in MIL-STD-1913 or ST ANAG 2324. Hand guards may be either permanently mounted to the weapon, or they may employ a "quick-attach/quick-detach" design that allows prompt separation into two parts once fasteners or other connection is released. Examples of firearms usable with the present invention coupler assembly include the AR family of automatic rifles, including but not limited to the AR 15, AR 18, AR 10, and AR 7, as well as rifles having the following caliber designations 5 mm, 17 caliber, 5.7 mm 22 short, 22 long rifle, 22 Magnum, .224 caliber, .223 caliber, 5.56 mm, 5.7 mm, 204 Ruger, 6.8 mm, 300 Whisper 300 Blackout, 7.62×39, .308 caliber, 7.62×51, 7.62×54, 338 federal, 243 caliber, 260 Remington, 6.5 mm, and 6.5 Creedmore. By providing structure not otherwise known in the prior art, the present invention coupler assembly is able to mount almost every hand guard currently marketed to the upper receivers of the AR family of rifles, and to other rifles as well, while also providing the additional advantage of quick barrel change.

BRIEF SUMMARY OF THE INVENTION

The primary objective of this invention is to provide a coupler assembly that will support and releasably mount almost every non-permanently mounted hand guard assembly currently marketed to the upper receivers of the AR family of rifles, while securely fixing a barrel against the forward end of the upper receiver of the rifle in a manner that facilitates and allows quick barrel change. A further objective of this invention is to provide a coupler assembly with a design allowing both quick attachment and quick detachment of a rifle barrel. It is also an objective of this invention to provide a coupler assembly with a barrel nut and a two-piece separable extension that have a fixed and secure rotation-preventing connection between them. In addition, it is also an objective of this invention for the two pieces of its extension to have rapid separation from one another once the extension is detached from the barrel nut, and also rapid reassembly to one another for prompt and easy reconnection of the two-piece extension to the barrel nut. A further objective of this invention is to provide a barrel nut with structure and design that allows for cost-efficient manufacture. It is also an objective of this invention to provide at least one fastener-tool configured as a hand guard fastener that can be stored/carried on a hand guard assembly mounted upon the present invention barrel nut, allowing readily available access to the fastener-tool by hunters and outdoorsmen to attach and remove the two-piece extension to/from the barrel nut for prompt barrel change. It is also an objective of this invention to provide additional fastener-tools that can be stored/carried on a hand guard assembly mounted upon the present invention barrel nut, allowing hunters and outdoorsmen immediate access to other useful tools while in the field, such as but not limited to a pick tool, strike tool, bolt cleaner tool, pin punch, Phillips or flathead screwdriver, and the like.

The present invention coupler assembly has a generally cylindrical barrel nut with a plurality of exterior rail-mounting gear-like teeth centrally around its exterior circumference which assist in mounting almost every hand guard assembly currently marketed to the upper receiver of the AR family of rifles. The interior threads of the barrel nut, used in part for its connection to the upper receiver of a rifle, also help to establish secure and stable positioning for a rifle barrel via entrapment of its flange against the rifle's upper receiver. Furthermore, when the upper receiver and the two-piece separable extension are both are securely connected to the barrel nut, causing the flange at the receiver end of the rifle's barrel to become wedged/trapped between the upper receiver and the extension, the interior threads within the barrel nut also closely surround the perimeter edge of the flange, further providing reduced opportunity for lateral movement of the flange and remainder portion of the rifle barrel during rifle use. In addition, the multiple fastener holes in the non-threaded end of the barrel nut allow set screws to be inserted through them for contact with the two-piece separable extension to provide rotation-preventing engagement between the two-piece separable extension and the barrel nut, further stabilizing rifle barrel positioning. Facilitated barrel access through use of the present invention coupler assembly is derived in part from the quick separation of the two-piece extension from the barrel nut, the ease with which the two pieces of the extension separate from one another after release of its connection to the barrel nut, and preferred use of a fastener-tool that is configured as a hand guard fastener, stored/carried on the hand guard assembly where it is immediately available to hunters and outdoorsmen, and also configured to tighten/release set screws and/or assist in the tightening/release of the two-piece extension to/from the present invention barrel nut. Furthermore, the structural simplicity of the present invention barrel nut and its two-piece extension also allow for cost-efficient manufacture. Additional fastener-tools can also be optionally configured to assist a hunter or other outdoorsman by performing other functions (in addition to set screw installation and release), and when idle they can also be easily carried by the hand guard assembly for prompt availability. Fastener-tool functions can include, but are not limited to those of a screwdriver, a sight adjustment tool, an automatic rifle bolt or carrier cleaning tool, a striking rod, a pick tool, or a pin punch. Also, the fastener-tool's handle end may varied to perform differing functions, such as being configured to engage optional notches on the extension's barrel end and facilitate/quicken its release from the present invention barrel nut. Another configuration contemplated for a fastener-tool's multifunction handle end is that of a sling swivel mount. These and other features, aspects, and advantages of the invention will be further understood and appreciated by those skilled in the art by reference to the following written specification, claims, and appended drawings.

BRIEF DESCRIPTION OF THE SEVERAL VIEWS OF THE DRAWINGS

Preferred embodiments of the present invention will now be described, by way of example, with reference to the accompanying drawings, wherein like numerals denote like elements throughout the various views of the drawings, and in which.

DETAILED DESCRIPTION OF THE INVENTION

The present invention is a quick-attach/quick-detach coupler assembly (1, 5) used for mounting a non-permanent hand guard (not shown) around the barrel 18 of a rifle while also allowing prompt access to, and quick change of, barrel 18. It should be understood that more than one preferred embodiment is considered to be within the scope of the present invention. As a result, the embodiment disclosed herein and in the accompanying illustrations is only exemplary of the most preferred structure intended for patent protection. Therefore, the present invention should be considered to encompass all non-patentably distinct embodiments and methods found within the scope and spirit of the invention as defined in the accompanying claims.

Figure 13:
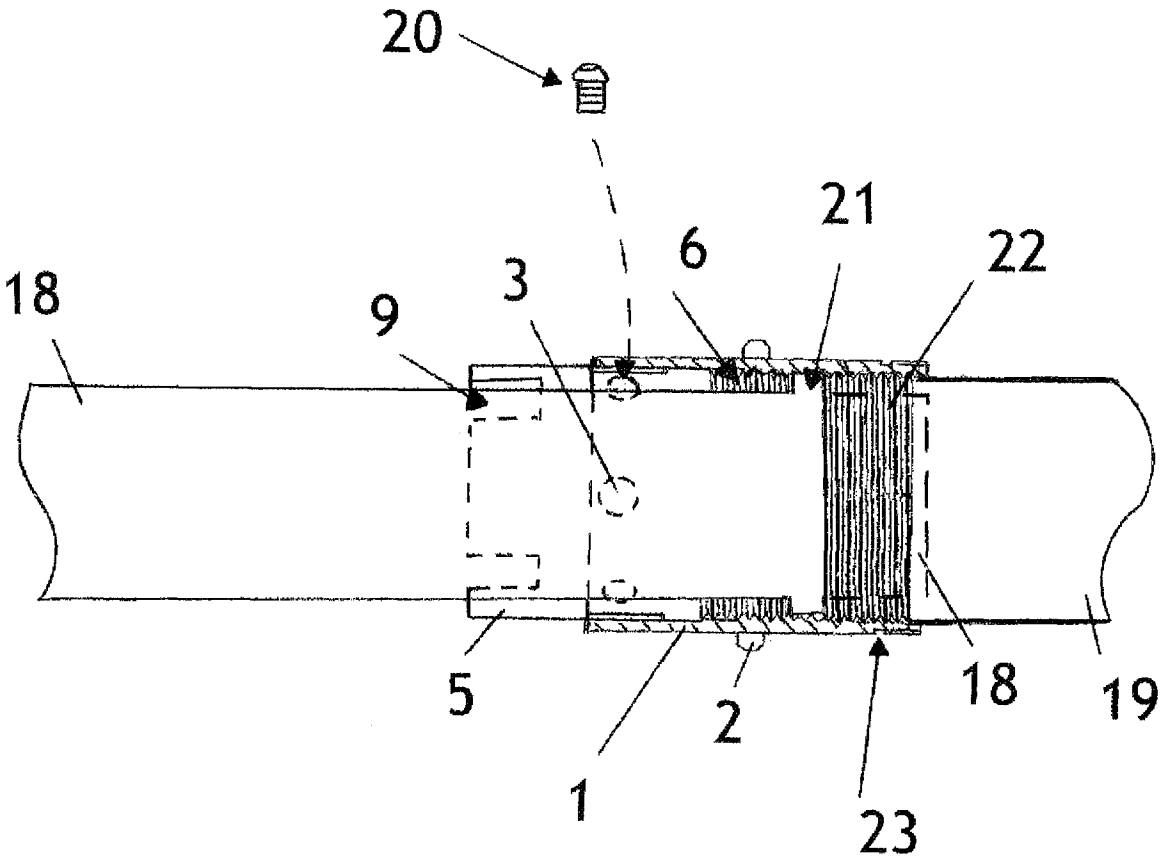
FIG. 13 is a sectioned view of the most preferred embodiment of the present invention coupler assembly having its barrel nut connected to its two-piece extension, the upper receiver of a rifle connected to the receiver end of the barrel nut, and the receiver end of a rifle barrel inserted within the two-piece extension so that the flange on the receiver end of the rifle barrel becomes sandwiched between the forward end of the upper receiver and the threaded end of the two-piece extension, with FIG. 13 also showing a set screw poised for insertion into one of the threaded fastener holes in the barrel nut during which it would provide rotation-preventing connection between the barrel nut and the two-piece extension to additionally secure their threaded connection during rifle use.
Figure 14:
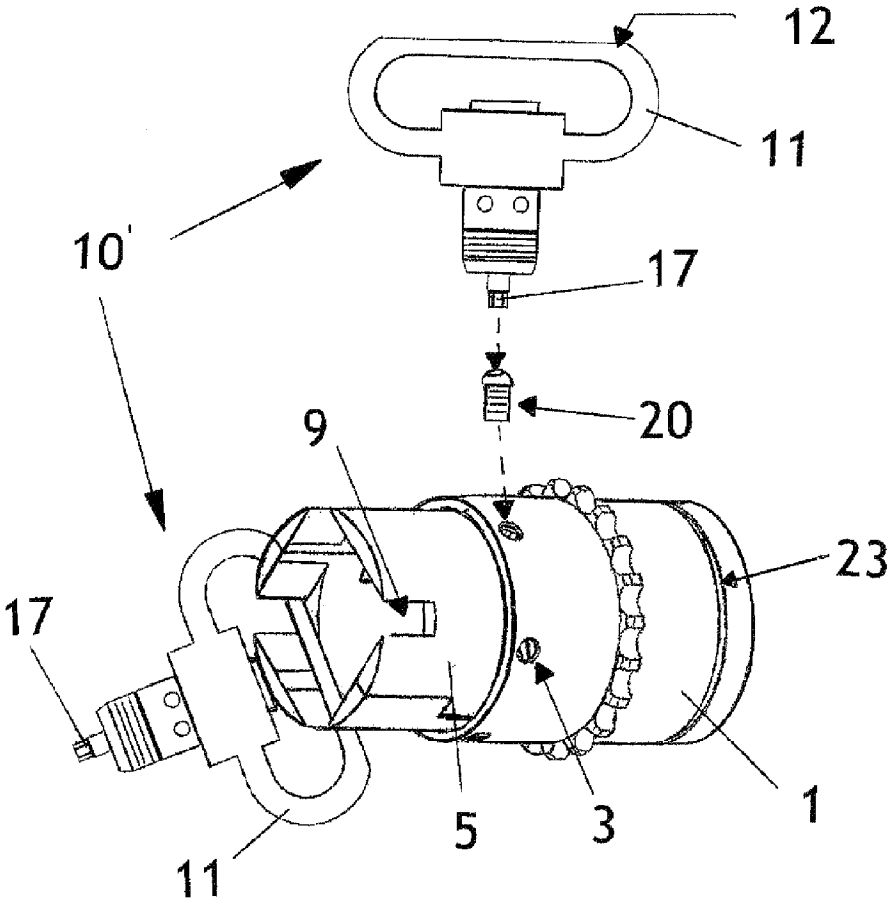
FIG. 14 is a perspective view of the most preferred embodiment of the present invention barrel nut connected to the most preferred embodiment of the present invention two-piece extension, with a first representation of a present invention fastener-tool poised with its tool end ready to assist in securing a set screw within a threaded fastener hole in the barrel nut to provide additional rotation-preventing connection between the barrel nut and the two-piece extension during rifle use, and a second representation of the same fastener-tool with the flattened loop on its opposing end engaging notches on the barrel end of the two-piece extension to assist in prompt disconnection of the extension from the barrel nut, and further with the barrel and upper receiver shown in FIG. 13 omitted in FIG. 14 for clarity in illustrating the flattened loop's positioning in extension notches.

An important advantage of the most preferred embodiments of the present invention coupler assembly (1, 5) is that they can be used to mount almost every hand guard currently marketed to the upper receiver 19 of the AR family of rifles. While FIGS. 1-4 illustrate the components and features of the same preferred embodiment of present invention barrel nut 1, FIGS. 5-9 illustrate the components and features of the same preferred embodiment of present invention separable two-piece extension 5 which has a threaded connection to barrel nut 1 during their use together around a rifle barrel 18. Furthermore, FIGS. 10-12 respectively illustrate preferred fastener-tools 10, 15, and 10" usable as a part of the present invention for attachment and disconnection of two-piece extension 5 to/from barrel nut 1. In addition, FIG. 13 illustrates preferred positioning of barrel nut 1 and two-piece extension 5 in association with a rifle barrel 18 and a rifle's upper receiver 19, while FIG. 14 shows barrel nut 1 and two-piece extension 5 connected to one another and two representations of the same fastener-tool 10' each oriented and positioned for functional engagement of a different one of its opposing ends to assist in prompt attachment/release of the connection between two-piece extension 5 and barrel nut 1.

Figure 1:
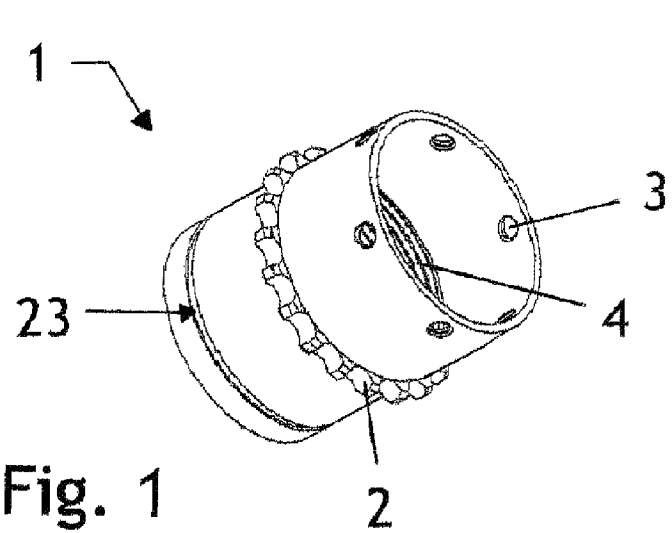
FIG. 1 is a perspective view of the most preferred embodiment of barrel nut used as a part of the present invention multi-caliber quick-attach/quick-detach coupler assembly, with the barrel nut having a generally cylindrical and open-ended configuration with a plurality of radially-extending and rail-mounting gear-like teeth centrally around its exterior circumference, interior threads on its receiver end for its attachment to the upper receiver of a rifle as well as independent attachment to the two-piece extension shown in FIGS. 5-9 for entrapment of the flange of a rifle barrel against the rifle's upper receiver, and multiple set screw fastener holes through its non-threaded barrel end that assist in securely fixing the barrel nut to the two-piece extension and preventing rotation of one relative to the other during rifle use.

FIGS. 1-4 illustrate the components and features of the most preferred embodiment of the present invention's barrel nut 1. FIG. 1 is a perspective view of the most preferred embodiment of barrel nut 1 showing barrel nut 1 comprising a generally cylindrical and open-ended configuration with a plurality of radially-extending and rail-mounting gear-like teeth 2 centrally located around its exterior circumference. Substantially centered positioning of teeth 2 between the receiver and barrel ends of barrel nut 1 is preferred, but not critical. Also, while the number, positioning, and configuration of radially-extending and rail-mounting gear-like teeth 2 shown in FIG. 1 are also preferred, none is critical as long as sufficient support for mounting a hand guard assembly (not shown) is provided. The exterior groove 23 shown in FIG. 1 near its receiver end is used with the barrel snap ring (not shown) required when older style hand guards are mounted on and supported by barrel nut 1. Although not shown, tension provided by a spring positioned between the delta ring on the hand guard and the snap ring engaging exterior groove 23 holds the hand guard in place between the radially-extending and rail-mounting gear-like teeth 2 on barrel nut 1 and the snap ring engaging exterior groove 23. Release of the spring tension allows removal of the hand guard away from rifle barrel 18 for subsequent removal of rifle barrel 18 once the two pieces 7 and 8 of extension 5 are separated and removed from barrel nut 1. FIG. 1 also shows interior threads 4 on the receiver end of barrel nut 1 that are used for attachment of barrel nut 1 to complementary, exterior threads 22 on the upper receiver 19 (see FIG. 13) of a rifle, as well as complementary, exterior threads 6 on the most preferred embodiment of two-piece extension 5 that is shown in FIGS. 5-9 and used for entrapment of the flange 21 of a rifle barrel 18 within barrel nut 1 between the forward end of rifle's upper receiver 19 and the externally threaded end 6 of the two-piece extension 5. In addition, FIG. 1 shows six fastener holes 3 through its non-threaded barrel end that with multiple set screws 20 (such as that shown in FIGS. 13 and 14) assist in securely fixing barrel nut 1 to the two-piece extension 5 to prevent rotation of one relative to the other during rifle use. Although six set screw fastener holes 3 are shown in FIG. 1 and preferred, the number, size, and positioning of fastener holes 3 present are not critical as long as a secure rotation-preventing connection is established between barrel nut 1 and two-piece extension 5.

Figure 2:
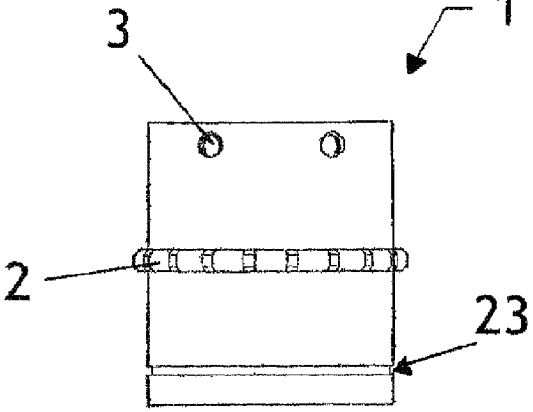
FIG. 2 is a side view of the most preferred embodiment of the present invention barrel nut shown in FIG. 1.

FIG. 2 is a side view of the most preferred embodiment of the present invention barrel nut 1 in FIG. 1, and also shows the rail-mounting gear-like teeth 2 centrally around the exterior surface of barrel nut 1, the exterior groove 23 near the receiver end of barrel nut 1 that can be used with teeth 2 for connection of older style hand guards (not shown) to barrel nut 1, and several of the fastener holes 3 near the non-threaded barrel end of barrel nut 1 that are each used to receive a set screw 20 to provide a rotation-preventing connection between barrel nut 1 and extension 5 during rifle use. The width and depth of exterior groove 23 may be different from that shown in FIG. 2, and is not critical as long as secure mounting of older hand guards on barrel nut 1 is achieved. Furthermore, in differing embodiments of the present invention the size of threaded fastener holes 3 may be larger or smaller in proportion to the barrel nut 1 than is shown in FIG. 2, and other embodiments of the present invention may have a different number of threaded fastener holes 3 that is greater or less than the six fastener holes 3 used as a part of the most preferred embodiment of the present invention barrel nut 1. Thus, the features mentioned for the structure of barrel nut 1 have importance to its function. However, some variation is expected and allowed without sacrificing the effectiveness of barrel nut 1 function.

Figure 3:
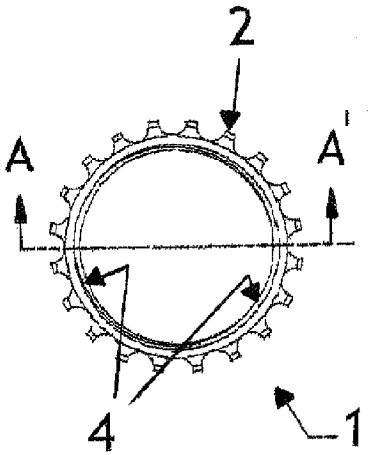
FIG. 3 is a top view of the most preferred embodiment of the present invention barrel nut shown in FIG. 1.
Figure 4:
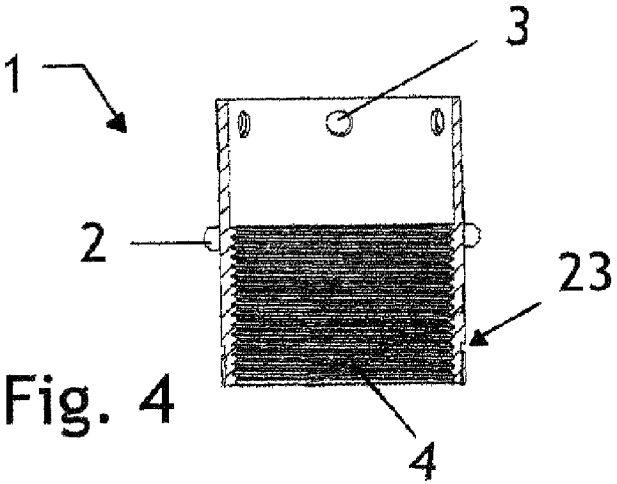
FIG. 4 is a sectioned view taken along the line A-A' in FIG. 3, and showing the interior threads extending substantially within the lower half of the barrel nut.

FIG. 3 is a top view of the most preferred embodiment of the present invention barrel nut 1 shown in FIGS. 1 and 2, and illustrates twenty rail-mounting gear-like teeth 2 centrally around the exterior surface of barrel nut 1. In addition to use for mounting a hand guard assembly (not shown) to barrel nut 1, gear-like teeth 2 can also be used to securely torque barrel nut 1 onto a rifle's upper receiver 19. In contrast, FIG. 4 shows the interior threads 4 positioned on the interior circumference of barrel nut 1. In the sectioned view in FIG. 4, which is taken along the line A-A' in FIG. 3, the interior threads 4 in barrel nut 1 are shown extending substantially within the receiver end (lower half) of barrel nut 1, leaving most of the interior surface of barrel nut 1 on its barrel end (above rail-mounting gear-like teeth 2) in a non-threaded condition. As seen in FIG. 13, the tubular configuration of barrel nut 1 includes a central axis that substantially corresponds to the central axis of the bore of an associated rifle barrel 18. Those practiced in the art will readily understand that the male threads 22 on rifle receiver 19 may be different on different rifle designs, and as a result the interior threads 4 on the receiver end of barrel nut 1 may be adapted to the particular design of rifle receiver 19 so that barrel nut 1 may be securely affixed to upper receiver 19 during rifle use. Although not shown, barrel nut 1 may also include a slot configured for receiving an end of a spanner wrench (not shown) for tightening barrel nut 1 onto upper receiver 19 in a manner common to, and known by, those practiced in the art. Although not limited thereto, barrel nut 1 may be made from stainless steel having a hard chrome finish.

Figure 6:
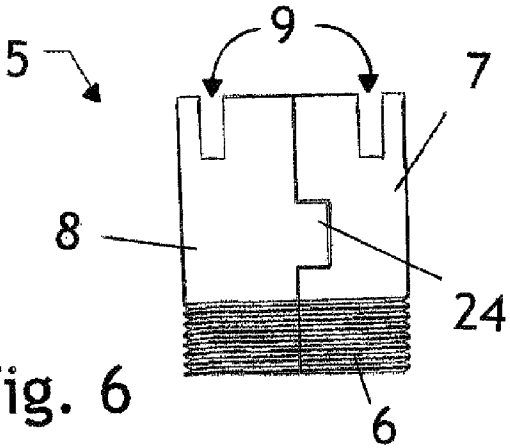
FIG. 6 is a side view of the most preferred embodiment of the present invention two-piece extension shown in FIG. 5.
Figure 9:
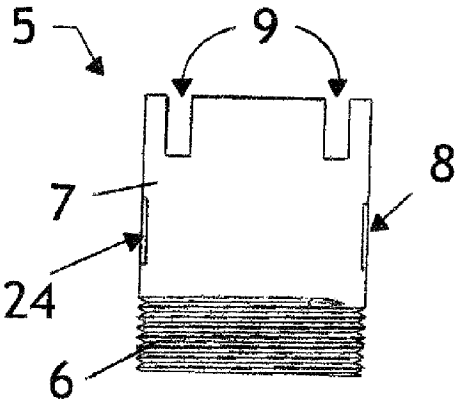
FIG. 9 is a side view of the most preferred embodiment of the present invention two-piece extension shown in FIGS. 5-8, with the orientation of the two-piece extension approximately 90-degrees from that shown in FIG. 6.
Figure 5:
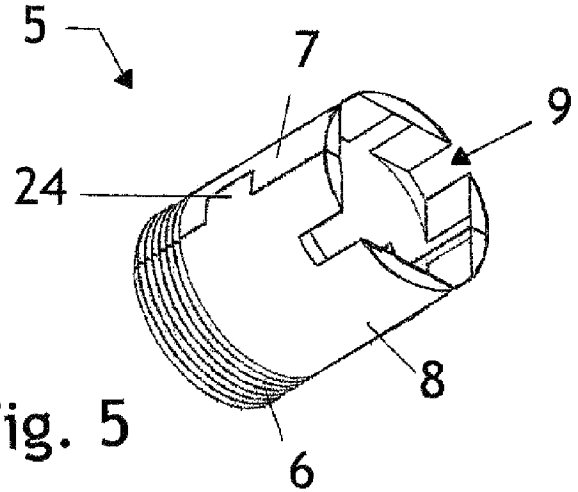
FIG. 5 is a perspective view of the most preferred embodiment of a two-piece separable extension usable as a part of the present invention multi-caliber quick-attach/quick-detach coupler assembly, showing exterior threads on one of its ends and four optional notches on its opposing end that can be used for facilitating a threaded connection with the barrel nut for entrapment of the flange of a rifle barrel between the extension and the forward end of a rifle's upper receiver.
Figure 8:
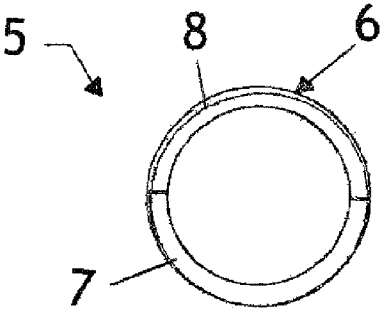
FIG. 8 is a bottom view of the most preferred embodiment of the present invention two-piece extension shown in FIGS. 5-7.
Figure 7:
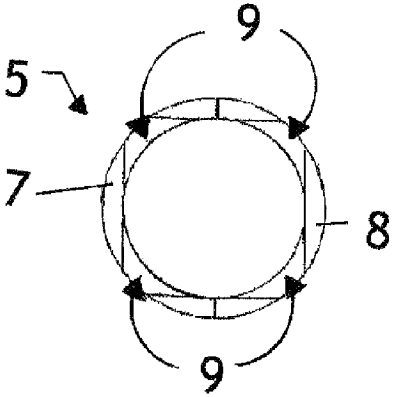
FIG. 7 is a top view of the most preferred embodiment of the present invention two-piece extension shown in FIGS. 5 and 6 showing its optional notches equally spaced-apart from one another.

FIGS. 5-9 illustrate the components and features of the most preferred embodiment of present invention's separable two-piece extension 5. FIG. 5 is a perspective view of the most preferred embodiment of extension 5, showing its two pieces 7 and 8 with an easily-released interlocking connection 24 between them (which is shown on each of their sides in FIG. 9), exterior threads 6 on its receiver end, and optional notches 9 on its barrel end. Although not shown, instead of notches 9 the barrel end of two-piece extension 5 may have at least one aperture, slot, or other feature allowing a tool to grip and rotate extension 5 to release its threaded connection with barrel nut 1 (and/or provide sufficient torque needed to tighten its threaded connection with barrel nut 1). FIG. 6 is a side view of the most preferred embodiment of extension 5 which also shows the threads 6 on its receiver end, the secure yet easily releasable interlocking connection 24 between extension pieces 7 and 8, and two of the optional notches 9 on the barrel end of extension 5 used to assist in the threaded connection of extension 5 to barrel nut 1, as well as the disconnection and separation of extension 5 from barrel nut 1. FIG. 7 is a top view of the most preferred embodiment of extension 5 which illustrates the preferred, but not critical, equally spaced-apart relation of four notches 9. FIG. 8 is a bottom view of the most preferred embodiment of extension 5, showing the unadorned bottom surface of extension 5 and the positioning of exterior threads 6. FIG. 9 is a side view of the most preferred embodiment of extension 5 with the orientation of the two-piece extension 5 shown in FIG. 9 rotated approximately 90-degrees from the two-piece extension 5 in FIG. 6. Threads 6 are marked on the receiver end of extension 5 in FIG. 9, and the interlocking connection 24 between extension pieces 7 and 8 is also shown in FIG. 9, as well as two of the optional notches 9 on the barrel end of extension 5. Although four notches 9 are shown in FIGS. 5 and 7, and four notches 9 are most preferred for user convenience and prompt barrel 18 change, it is considered within the scope of the present invention for notches 9 to be optional, and as a result extension 5 may have more than four notches 9 on its barrel end, perhaps only two notches 9, or no notches 9. When no notches 9 are present, instead of a conveniently accessed and readily available fastener-tool (10, 10', 10", 15, or other) being used to assist in the rotation of extension 5 to release the exterior threads 6 on extension 5 from their connection to interior threads 4 on barrel nut 1, another tool can be used, such as but not limited to a spanner wrench (not shown). Also, although not shown, when a spanner wrench or other independent tool (one not carried by a hand guard mounted on barrel nut 1) is used to disconnect extension 5 from barrel nut 1 for quick barrel 18 change, one or more apertures, slots or other openings/indentations in extension 5 may be present to assist prompt function of the independent tool. In addition, it is contemplated and considered to be within the scope of the present invention for notches 9 to be longer and/or wider than shown in FIGS. 5, 6, and 9, or have a different shape or spaced-apart distance from one another, as long as the intended connection/disconnection function for extension 5 with a fastener-tool (10, 10', 10", 15, or other) can still be accomplished. Furthermore, while FIGS. 5, 6, and 9 show the two pieces 7 and 8 of extension 5 have one substantially rectangular interlocking snap-fit or tongue-and-groove-like connection 24 on each of its opposing sides, the interlocking connection 24 between extension pieces 7 and 8 should not be considered as limited to the single, rectangular configuration shown. For example, it is also contemplated for the interlocking connection 24 between extension pieces 7 and 8 to comprise two or more spaced-apart rectangular configurations on one or both of the joined sides of extension pieces 7 and 8, or for the shape of the interlocking connection 24 to comprise a non-rectangular configuration. Therefore, instead of a specific structural design, the interlocking connection 24 between adjacent sides of extension pieces 7 and 8 should be considered as a connection sufficiently secure to hold extension pieces 7 and 8 together while extension 5 is being attached to and separated from barrel nut 1, yet allows extension pieces 7 and 8 to be easily separable from one another once extension 5 is released from barrel nut 1. Furthermore, one must appreciate that the thread count of the threads 6, 4, and 22 shown in the accompanying illustrations are merely exemplary, and the present invention should not be limited only to those shown. In addition, the diameter and length dimensions of extension 5 may also vary from that shown in the accompanying illustrations, as long as a secure threaded connection with barrel nut 1 can still be accomplished and the other intended functions of extension 5 can still effectively occur.

Figure 12:
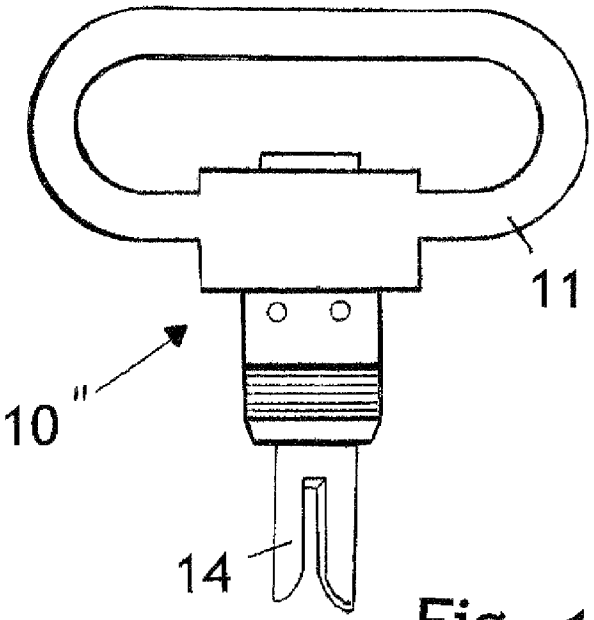
FIG. 12 is a perspective view of a third preferred embodiment of the present invention fastener-tool having one end configured as an automatic rifle bolt carrier cleaning tool and its other end configured as a loop usable as a sling mount.
Figure 10:
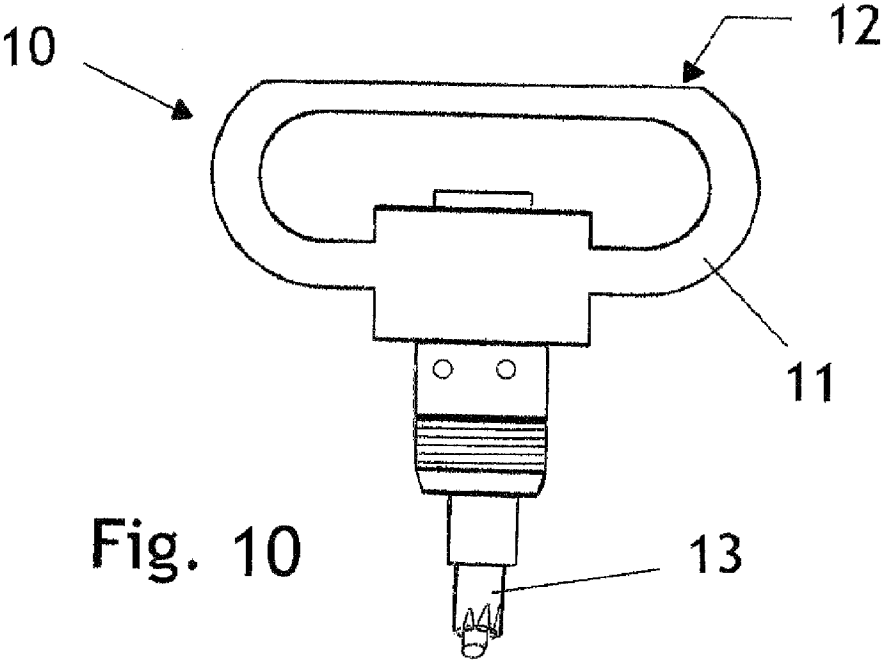
FIG. 10 is a perspective view of a first preferred embodiment of fastener-tool usable as part of the present invention which shows its tool end configured as an automatic rifle bolt cleaning tool and its other end configured with a flattened loop that could be used to engage adjacent extension notches and facilitate rotation of the extension relative to the barrel nut, facilitating attachment or release of the extension to/from the barrel nut.
Figure 11:
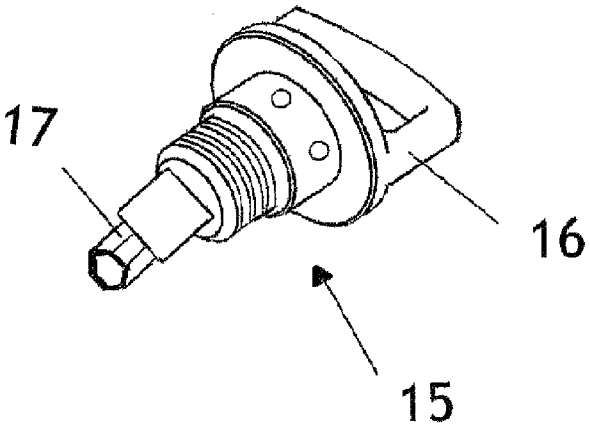
FIG. 11 is a perspective view of a second preferred embodiment of the present invention fastener-tool having one end configured as a hex key wrench tool its opposing end configured simply as a handle.

FIGS. 10-12 show several quick-attach/quick-detach multi-caliber and multifunction fasteners (10, 15, and 10") used as a part of the present invention and capable of connecting hand guard components (not shown) together onto and around barrel nut 1. However, since each fastener (10, 15, and 10") also performs a tool-like function, it is referred to herein as a 'fastener-tool' (10, 10', 10", 15, or other). In addition, FIGS. 13 and 14 demonstrate how a similar fastener-tool 10' can be positioned to assist in the connection (or disconnection) of extension 5 from barrel nut 1. In FIG. 13 the present invention coupler assembly (1, 5) is shown in association with a rifle barrel 18 and the forward end of a rifle's upper receiver 19, while FIG. 14 shows one method of using a first representation of a fastener-tool 10' with the notches 9 present on the barrel end of two-piece extension 5 to engage/disengage the threaded connection (4, 6) between extension 5 and barrel nut 1. FIG. 14 further shows a second representation of the same fastener-tool 10' with its opposing tool end 17 poised to assist with the insertion or removal of a set screw 20 into/from one of several threaded holes 3 shown in the barrel end of barrel nut 1, and when the set screws 20 are in contact with the outer surface of extension 5 they provide a rotation-preventing connection that allows the threaded connection between extension 5 and barrel nut 1 to remain fixed and secure during rifle use.

FIG. 10 is a perspective view of first preferred embodiment of a fastener-tool 10 usable as a part of preferred embodiments of the present invention and having one end configured as an automatic rifle bolt carrier cleaning tool 13, while its opposed handle end is configured as a swing swivel mount having a flattened loop 12. FIG. 11 is a perspective view of a second preferred embodiment of a fastener-tool 15 usable as a part of preferred embodiments of the present invention which has a spring plunger end configured as an hex key wrench tool 17 and its other end configured as a push-button quick-release handle 16 (similar to that used as a part of a quick-release spring-loaded detent screw). Although not limited thereto, fastener-tool 15 may be made from stainless steel. In contrast, FIG. 12 is a perspective view of a third preferred embodiment of a tool 10" usable as a part of preferred embodiments of the present invention which has one end configured as an automatic rifle bolt carrier cleaning tool 14, while its opposed handle end is configured as a loop 11 for use as a rifle swing swivel mount. A similar and also preferred embodiment of the present invention fastener-tool 10' is identified in FIG. 14 and has a loop 11 with a flattened side 12 on one of its ends and an opposed hex key wrench tool 17 that together allow the tool mechanism to perform several functions. The loop 11 of the present invention fastener-tool 10' may be used as a sling mount or its flattened side 12 may be used with two of the notches 9 on extension 5 as a tool to assist in the separation of the threaded connection (6, 4) between barrel nut 1 and two-piece separable extension (5 or other). In the alternative, the opposing end of fastener-tool 10' having the configuration of a hex key wrench tool 17 may be used in several ways: 1) as a fastener to help assemble the pieces of a hand guard (not shown) when it is mounted on barrel nut 1, 2) used as a tool for installing and removing set screws 20 that are used with the fastener holes 3 in barrel nut 1 to secure/separate the rotation-preventing additional connection of barrel nut 1 to extension 5 wherein set screws 20 contact the outer surface of two-piece extension 5, and 3) also used as a means of connection to a hand guard component so that after the flattened side 12 of loop 11 is aligned with two adjacent distal notches 9 on extension 5, the hand guard component can be employed as a handle to apply rotational force to extension 5 via loop 11, promptly releasing the threaded connection (4, 6) between extension 5 and barrel nut 1 while barrel nut 1 remains in fixed connection with upper receiver 19.

Once separated from barrel nut 1, the two pieces 7 and 8 of extension 5 easily detach from one another and expose the rifle's barrel 18. Also, once extension 5 is removed, the flange 21 of rifle barrel 18 is no longer trapped between extension 5 and upper receiver 19, and barrel 18 can be easily and promptly withdrawn from barrel nut 1 toward and through its non-threaded barrel end (see FIG. 13). Reversing the above-identified steps, the most preferred fastener-tool 10' (in association with a connected hand guard component that helps to apply rotational force to extension 5 via loop 11) can also be used to easily and promptly reassemble a forward hand guard assembly around a rifle barrel 18 and barrel nut 1 without independent tools. Furthermore, while at least one present invention fastener-tool 10' is typically associated with a hand guard assembly (not shown) mounted on the present invention barrel nut 1 and extending around a rifle barrel 18, either helping to secure hand guard components together, or simply carried/stored on the hand guard assembly so that use of the flattened side 12 of its loop 11 and the hex key wrench tool 17 will allow quick access to a rifle's barrel 18, one or more other present invention fastener-tools (10, 10", 15, or other) could also be associated with the same hand guard assembly, each having a different tool end, such as but not limited to that configured as an automatic rifle bolt cleaning tool, an automatic rifle bolt carrier cleaning tool, a front or rear sight adjustment tool, an hex key wrench tool, a star or torx system tool, a single cut angle barb pick tool, a round rod pin punch, a slot screwdriver bit, a Phillips screwdriver bit, or a striking rod for starting a fire, just to name a few examples of the many tool end configurations that would be convenient for a hunter to have readily available in the field. Since each present invention fastener-tool mechanism (10, 10', 10", 15, or other) has a compact footprint, it is lightweight and efficiently carried, and is also readily accessible in an instant. While FIGS. 10-12 show three quick-attach/quick-detach multi-caliber and multifunction fastener-tools (respectively (10, 15, and 10"), the present invention fastener-tools (10, 10', 10", 15, or other) and their handle configurations (12, 16, 11) are not limited to the configurations shown in FIGS. 10-12, it is considered to be within the scope of the present invention for any of the tool ends of the fastener-tools (10, 10', 10", 15, or other) used as a part of with the present invention to be associated with any handle (12, 16, 11, or other).

In combination, FIGS. 13 and 14 help to explain how tools (10, 10', 10", and 15, or other) shown in FIGS. 10-12 can be used as a part of the present invention to assist in connecting or separating extension 5 and barrel nut 1 from one another. As illustrated in FIG. 13, the exterior threads 22 on the forward end of the upper receiver 19 of a rifle engage the interior threads 4 within barrel nut 1 on its receiver end, while the exterior threads 6 on the barrel end of extension 5 (shown in FIGS. 5, 6, and 9) engage the threads 4 within barrel nut 1 that are positioned closer to the non-threaded end of barrel nut 1 and the fastener holes 3, with the combined connections of the receiver end of two-piece extension 5 and the forward end of the upper receiver 19 both to barrel nut 1, causing the opposing surfaces of the flange 21 on the receiver end of a barrel 18 to become sandwiched/trapped between extension 5 and upper receiver 19. As shown in FIG. 14, a fastener-tool 10' configured in part as a hand guard fastener and stored/carried on a hand guard assembly (not shown) mounted upon the gear-like teeth 2 of the present invention barrel nut 1, would be easily accessed for use of its tool end to tighten/release a set screw 20 within each of the fastener holes 3 present in barrel nut 1 so that it makes contact with the outer surface of extension 5, preventing rotation between extension 5 and barrel nut 1 during rifle use. The opposed handle (11 and 16, or other) of the same fastener-tool (10, 10', 10", 15, or other) opposed handle (11 and 16, or other) may also be configured to engage notches 9 on the barrel end of two-piece extension 5 and provide rotational assistance to facilitate extension 5 attachment to, and release from, barrel nut 1. In the alternative, when optional notches 9 are not present, an independent tool (not shown) available to the hunter/outdoorsman may be used with extension 5 to attach and release a rifle barrel 18 having its flange 21 locked inside the present invention barrel nut 1. One example of an independent tool that could be used to rotate extension 5 is a spanner wrench. Once the two-piece separable extension 5 of the present invention becomes disconnected from barrel nut 1 through use of a rail-supported tool (10, 10', 10", 15, or other), spanner wrench (not shown), or other means, the two pieces (7, 8) of extension 5 are immediately separable from one another, further facilitating fast/prompt change of the rifle barrel 18 locked within barrel nut 1 by extension 5.

FIG. 13 is a partially sectioned view of the most preferred embodiment of the present invention coupler assembly (1, 5) having its barrel nut 1 connected to its two-piece extension 5, the upper receiver 19 of a rifle connected to the receiver end of barrel nut 1, and the receiver end of a rifle barrel 18 inserted within the two-piece extension 5 so that the flange 21 on the receiver end of barrel 18 becomes sandwiched between the forward end of the upper receiver 19 and the end of two-piece extension 5 having threads 6, with FIG. 13 also showing a set screw 20 poised for connection to one of the fastener holes 3 in the barrel end of barrel nut 1 during which set screw 20 provides rotation-preventing connection between barrel nut 1 and extension 5 during rifle use. In contrast, FIG. 14 is a perspective view of the most preferred embodiment of the present invention barrel nut 1 connected to the most preferred embodiment of the present invention two-piece extension 5, with one present invention tool 10' poised with its tool end 17 ready to assist in securing a set screw 20 within a fastener hole 3 to provide rotation-preventing connection between barrel nut 1 and extension 5 during rifle use, and the other representation of present invention tool 10' positioned so that its flattened loop 12 engages notches 9 on the barrel end of extension 5 to assist in disconnection of two-piece extension 5 from barrel nut 1 (after set screws 20 are first loosened and/or removed from fastener holes 3). The rifle barrel 18 and upper receiver 19 shown in FIG. 13 are omitted from FIG. 14 to provide emphasis and ease in illustrating the positioning of the flattened portion 12 of the loop end 11 of present invention tool 10' within two adjacent notches 9 on the barrel end of extension 5. In FIG. 13 it may appear that there might not be sufficient room for the flattened portion 12 of loop end 11 to be accommodated by the notches 9 of extension 5 when a rifle barrel 18 is present. However, when notches 9 are used to assist in the separation of two-piece extension 5 from barrel nut 1 for quick change of a barrel 18, the flattened portion 12 of loop end 11 and notches 9 are both sized, configured, and positioned so that sufficient clearance is provided and the flattened portion 12 of the loop end 11 of present invention tool 10' is able to engage two adjacent notches 9 and assist in the rotation of extension 5 relative to the barrel nut 1 while the barrel nut 1 maintains fixed positioning via its threaded connection to the upper receiver 19. Also, it should be remembered that the set screws 20 securing barrel nut 1 and extension 5 to one another must first be loosened and/or removed from fastener holes 3 prior to attempting to use tool 10' for release of the threaded connection between barrel nut 1 and extension 5. Threaded connection of the two-piece separable extension 5 to interior barrel nut 1 via its threads 4 and the complementary exterior threads 6 on the exterior surface of extension 5 after the barrel end of extension 5 passes through the non-threaded end of barrel nut 1, causes the flange 21 of rifle barrel 18 to become trapped between the upper receiver 19 and extension 5, locking the flange 21 of rifle barrel 18 between the two-piece extension 5 and the rifle's upper receiver 19 and providing immobile positioning of flange 21 and the remaining portion of barrel 18 during rifle use. Furthermore, it has been demonstrated herein how the locking and unlocking of barrel 18 can be accomplished using the present invention alone, without the need for any independent tools.

In summary, as shown in FIGS. 1-14, the present invention coupler assembly (1, 5) has a barrel nut 1 with a generally cylindrical and open-ended configuration, approximately half of which has interior threads 4 extending from its receiver end centrally into barrel nut 1. The portion of the interior threads 4 on barrel nut 1 closest to its receiver end are used for its connection to the upper receiver 19 (see FIG. 13) of a rifle, while the portion of interior threads 4 closer to the central portion of barrel nut 1 are used to releasably engage the complementary exterior threads 6 shown on the receiver end of a two-piece separable extension 5 (see FIGS. 5-9), allowing secure connection of two-piece extension 5 to barrel nut 1 around part of a rifle barrel 18 (see FIG. 13) during rifle use, while also allowing prompt and easy release of two-piece extension 5 for quick access to and change of barrel 18. When barrel nut 1 is connected to the upper receiver 19 of a rifle and two-piece extension 5 with the barrel 18 of a rifle extending through extension 5 and barrel nut 1, the present invention coupler assembly (1, 5) is ready for a hand guard assembly to be mounted on the exterior and radially-extending gear-like teeth 2 encircling the outer surface of barrel nut 1. For versatility in mounting older style hand guards upon barrel nut 1, the groove 23 adjacent to the receiver end of barrel nut 1 is used in combination with gear-like teeth 2. As illustrated in FIG. 13, when barrel nut 1 is connected to both upper receiver 19 and two-piece extension 5, the radially-extending flange 21 found on the receiver end of a rifle barrel 18 is sandwiched/trapped between the forward end of the upper receiver 19 and the receiver end of extension 5 having exterior threads 6. As barrel 18 is inserted into barrel nut 1 toward the forward end of upper receiver 19, flange 21 bottoms out against the forward end of upper receiver 19 while the portion of barrel 18 extending beyond flange 21 enters into the hollow center portion of upper receiver 19 (as shown in FIG. 13 via broken lines). FIG. 13 also shows the portion of barrel 18 extending beyond flange 21 positioned concentric to upper receiver 19 and without contact with any portion of its interior surface. In addition to being wedged/ trapped between the receiver end of two-piece extension 5 and the forward end of upper receiver 19, the outer perimeter of the barrel's flange 21 is also closely surrounded by adjacent portions of the threads 4 on the interior surface of barrel nut 1, which reduces/restricts the amount of lateral movement possible by flange 21 and the remainder of barrel 18 during rifle use. Thus, it is a combination of the entrapment of flange 21 by the threaded engagement of exterior threads 22 on upper receiver 19 with the interior threads 4 (see FIGS. 1 and 4) of barrel nut 1, and the subsequent threaded engagement of exterior threads 6 on two-piece extension 5 with the interior threads 4 centrally located within barrel nut 1, in further combination with the close association and limitation provided by the interior threads 4 within barrel nut 1 that restrict lateral movement of flange 21 within barrel nut 1, which together lock the flange 21 of barrel 18 securely in place for rifle use. In addition, barrel nut 1 purposefully has no interior threads 4 at or near its barrel end. Added threads 4 are not required for a secure connection of extension 5 to barrel nut 1, and the reduced number of interior threads 4 within barrel nut 1 assists in providing a faster release of extension 5 for prompt barrel 18 change. Thus, the exterior threads 6 on the outside surface of two-piece extension 5 pass through the non-threaded interior portion of barrel nut 1 before reaching and becoming engaged with the centrally-located portion of interior threads 4 on barrel nut 1 to lock the flange 21 of barrel 18 in place for rifle use. As preferred and shown in the accompanying illustrations, although not critical, the fastener holes 3 in barrel nut 1 are all approximately the same distance from one end of barrel nut 1. However, any arrangement of fastener holes 3 on the barrel end of barrel nut 1 should be considered within the scope of the present invention as long as sufficient connection between extension 5 and barrel nut 1 is established when set screws 20 are secured within fastener holes 3 to prevent rotation of extension 5 relative to barrel nut 1 during rifle use.

While the written description of the invention herein is exemplary and intended to enable one of ordinary skill to make and use its best mode, it should be appreciated that since the invention disclosure only provides examples of specific embodiments and methods, many variations to these preferred embodiments and methods also exist which are not specifically mentioned, including modifications, combinations, and equivalents. Thus, it is intended that all matters disclosed in the foregoing invention description, and shown in the accompanying drawings, be interpreted as illustrative and not in a limiting sense. The present invention herein should therefore not be considered as restricted to the above-described preferred embodiments, methods, and examples, but instead to encompass all non-patentably distinct embodiments and methods found within the scope and spirit of the invention as defined in the accompanying claims.

I claim:

1. A multi-caliber coupler assembly used to mount a hand guard assembly to the forward end of the upper receiver of a rifle and around a rifle barrel having a flange near its receiver end, said coupler assembly comprising: a generally cylindrical and open-ended barrel nut having a hollow interior, a barrel end, and a receiver end in an opposed position to said barrel end, said barrel nut further having interior fastening threads associated with said receiver end a portion of which extends centrally within said barrel nut, at least one threaded fastener hole associated with said barrel end, a plurality of aligned and spaced-apart exterior teeth extending radially outward from said barrel nut between said barrel end and said receiver end; an extension having a barrel end and an opposed receiver end, said extension also having two pieces configured for interlocking connection to one another yet remaining easily and promptly separable from one another, said receiver end of said extension having exterior fastening threads complementary to said interior fastening threads associated with said receiver end of said barrel nut such that a secure connection between said extension and said barrel nut can be achieved when said interior and said exterior threads are mated, said extension also having at least one rotation-assisting feature; at least one exterior-threaded fastener configured for receipt by and secured connection to said least one threaded fastener hole of said barrel nut, wherein when said interior fastening threads of said barrel nut engage the upper receiver of a rifle and provide secure connection of said barrel nut to the forward end of the upper receiver, and further when a rifle barrel is inserted through said hollow interior of said barrel nut so that its flange bottoms out against the forward end of the upper receiver, and in addition when said exterior fastening threads on said extension are mated within said hollow interior of barrel nut with said portion of said interior threads on said barrel nut extending centrally therein until said receiver end of said extension is positioned against the barrel's flange, trapping the flange between said extension and the upper receiver, and when said at least one exterior-threaded fastener is mated with said at least one fastener hole in said barrel end of said barrel nut until said at least one exterior-threaded fastener engages said extension, providing rotation-preventing connection between said extension and said barrel nut, many different hand guard assemblies can be mounted upon said aligned and spaced-apart exterior teeth extending radially outward from said barrel nut to the upper receiver of almost any automatic rifle, with said two-piece extension remaining readily removable from said barrel nut and providing prompt access to the rifle's barrel for quick barrel change.

2. The coupler assembly of claim 1 wherein said barrel nut further comprises an exterior groove positioned between said receiver end and said aligned and spaced-apart exterior teeth extending radially outward from said barrel nut and said barrel nut's receiver end, said exterior groove located to create a secure mounting to said barrel nut of a hand guard requiring tensioned engagement with said barrel nut.

3. The coupler assembly of claim 1 wherein said at least one fastener is a set screw.

4. The coupler assembly of claim 1 wherein said barrel end of said rotation-assisting feature on said extension further comprises a plurality of distally positioned notches.

5. The coupler assembly of claim 4 wherein said interlocking connection between said two pieces of said extension is positioned between said notches and said exterior threads on said extension's receiver end.

6. The coupler assembly of claim 4 further comprising a fastener-tool configured for attachment to a hand guard assembly and having opposing ends, one of said ends configured to engage said at least one exterior-threaded fastener and assist in securely mating said at least one exterior-threaded fastener with one of said fastener holes in said barrel nut.

7. The coupler assembly of claim 4 wherein the other one of said opposing ends is configured to engage two adjacent ones of said notches and maintain connection with said notched during rotation of said extension to mate said exterior threads of said extension to said interior threads of said barrel nut and release said exterior threads of said extension from said interior threads of said barrel nut.

8. A method of using the coupler assembly of claim 1 for quick access to a rifle barrel when a hand guard assembly does not surround and enclose said coupler assembly, said method comprising the steps of:

providing the coupler assembly of claim 1, a rifle having an upper receiver with a forward end, and a rifle barrel having a receiver end and a flange adjacent to said receiver end;

using said interior fastening threads of said barrel nut to engage said forward end of said upper receiver of said rifle to provide a secure connection between said barrel nut and said forward end;

inserting said rifle barrel through said hollow interior of said barrel nut so that said flange of said rifle bottoms out against said forward end;

inserting said receiver end of said extension into said hollow interior of said barrel nut and mating said exterior fastening threads on said extension with said portion of said interior threads on said barrel nut extending centrally therein until said receiver end of said extension is positioned against said flange of said barrel and said flange becomes securely fixed within said hollow interior of said barrel nut between said extension and said upper receiver; and mating said at least one exterior-threaded fastener with said at least one fastener hole in said barrel end of said barrel nut until said at least one exterior-threaded fastener engages and becomes securely fixed against said extension, and further provides anti-rotation connection between said extension and said barrel nut;

wherein quick access to said barrel comprises the steps of:

removing said at least one exterior-threaded fastener from said at least one fastener hole in said barrel end of said barrel nut;

removing said extension from said barrel nut;

separating said two pieces of said extension from one another and moving said two pieces remotely from said rifle barrel; and withdrawing said rifle barrel from said hollow interior of said barrel nut.

9. The method of claim 8 wherein said at least one fastener is a set screw.

10. The method of claim 8 wherein said barrel end of said rotation-assisting feature on said extension further comprises a plurality of distally positioned notches.

11. The method of claim 10 wherein said interlocking connection between said two pieces of said extension is positioned between said notches and said exterior threads on said extension's receiver end.

12. The method of claim 8 wherein said step of providing further comprises providing a fastener-tool configured for attachment to a hand guard assembly and having opposing ends, one of said opposed ends configured to engage said at least one exterior-threaded fastener and assist in securely mating said at least one exterior-threaded fastener with one of said fastener holes in said barrel nut, and wherein said method's step of removing said at least one exterior-threaded fastener from said at least one fastener hole is accomplished using said end of said fastener-tool configured to engage said at least one exterior-threaded fastener.

13. The method of claim 12 wherein the other one of said opposing ends of said fastener-tool is configured to engage two adjacent ones of said notches of said extension and maintain connection with said notches during rotation of said extension to mate said exterior threads of said extension to said interior threads of said barrel nut and also during release of said exterior threads on said extension from said interior threads of said barrel nut, and prior to said step of removing said extension from said barrel nut said method also comprising a step of using said other one of said opposing ends to engage said notches and assist in causing the rotation of said extension to release said exterior threads of said extension from mated connection with said interior threads of said barrel nut.

14. The method of claim 8 wherein said barrel nut of said coupler assembly of claim 1 further comprises an exterior groove positioned between said receiver end and said spaced-apart exterior teeth extending radially outward from said barrel nut, said step of providing further comprises the providing of a hand guard assembly mountable upon said barrel nut via tensioned engagement with said exterior groove, and prior to said step of removing said at least one exterior-threaded fastener also comprising a step of releasing said hand guard assembly from said tensioned engagement with said exterior groove and a subsequent step of removing said hand guard assembly away from said spaced-apart exterior teeth extending radially outward from said barrel nut.

* * * * *